US011502447B2

(12) United States Patent
Okayasu

(10) Patent No.: US 11,502,447 B2
(45) Date of Patent: Nov. 15, 2022

(54) CONNECTOR PROVIDED WITH GROOVE

(71) Applicant: SUMITOMO WIRING SYSTEMS, LTD., Mie (JP)

(72) Inventor: Yasushi Okayasu, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/281,570

(22) PCT Filed: Apr. 23, 2020

(86) PCT No.: PCT/JP2020/017537
§ 371 (c)(1),
(2) Date: Mar. 30, 2021

(87) PCT Pub. No.: WO2020/230581
PCT Pub. Date: Nov. 19, 2020

(65) Prior Publication Data

US 2021/0367372 A1 Nov. 25, 2021

(30) Foreign Application Priority Data

May 14, 2019 (JP) ..... JP2019-091644

(51) Int. Cl.
*H01R 13/52* (2006.01)
*H01R 13/502* (2006.01)
(Continued)

(52) U.S. Cl.
CPC ..... *H01R 13/5202* (2013.01); *H01R 13/502* (2013.01); *H01R 13/52* (2013.01);
(Continued)

(58) Field of Classification Search
CPC .. H01R 13/5202; H01R 13/502; H01R 13/52; H01R 13/6581; H01R 13/6596;
(Continued)

(56) References Cited

U.S. PATENT DOCUMENTS 5,417,587 A 5/1995 Katsuda et al.
8,562,377 B2 10/2013 Kawamura

FOREIGN PATENT DOCUMENTS

CN 206789772 U * 12/2017
CN 206789772 U 12/2017
(Continued)

OTHER PUBLICATIONS

International Search Report dated Jun. 23, 2020 for WO 2020/230581 A1 (5 pages).

*Primary Examiner* — Abdullah A Riyami
*Assistant Examiner* — Justin M Kratt
(74) *Attorney, Agent, or Firm* — Venjuris, P.C.

(57) ABSTRACT

A connector includes a connector housing and a shield shell. A terminal electrically connected to an end part of a wire is arranged inside the connector housing. The connector housing includes an inserting portion to be inserted into a mounting hole provided in a conductive case for accommodating an inverter and an outer arrangement portion integral with the inserting portion and to be arranged outside the case. The shield shell includes a tubular covering portion for covering an outer periphery of the outer arrangement portion and is electrically connected to the case. A shield-side sealing member seals between an outer-peripheral surface of the outer arrangement portion and an inner-peripheral surface of the covering portion. The outer-peripheral surface of the outer arrangement portion has a second intrusion suppressing groove provided over the entire outer periphery of the outer arrangement portion between the shield-side sealing member and the inserting portion.

3 Claims, 6 Drawing Sheets

(51) Int. Cl.

| | |
|---|---|
| ***H01R 13/6581*** | (2011.01) |
| ***H01R 13/6598*** | (2011.01) |
| ***H01R 13/74*** | (2006.01) |
| ***H01R 13/6596*** | (2011.01) |
| *H01R 13/73* | (2006.01) |
| *H01R 103/00* | (2006.01) |
| *H01R 13/506* | (2006.01) |

(52) U.S. Cl.
CPC ..... *H01R 13/6581* (2013.01); *H01R 13/6596* (2013.01); *H01R 13/6598* (2013.01); *H01R 13/74* (2013.01); *H01R 13/748* (2013.01); *H01R 13/506* (2013.01); *H01R 13/73* (2013.01); *H01R 2103/00* (2013.01); *H01R 2201/26* (2013.01)

(58) Field of Classification Search
CPC .. H01R 13/6598; H01R 13/74; H01R 13/748; H01R 13/506; H01R 13/73; H01R 2103/00; H01R 2201/26
See application file for complete search history.

(56) References Cited

FOREIGN PATENT DOCUMENTS

| | | | | |
|---|---|---|---|---|
| JP | 2011-071362 | A | | 4/2011 |
| JP | 2015-017551 | A | | 1/2015 |
| JP | 2016192288 | A | * | 11/2016 |

* cited by examiner

CONNECTOR PROVIDED WITH GROOVE

CROSS REFERENCE TO RELATED APPLICATIONS

This application is a national phase of PCT application No. PCT/JP2020/017537, filed on 23 Apr. 2020, which claims priority from Japanese patent application No. 2019-091644, filed on 14 May 2019, all of which are incorporated herein by reference.

TECHNICAL FIELD

The present disclosure relates to a connector.

BACKGROUND

Conventionally, some of connectors to be mounted on a case accommodating a device to be installed in a vehicle are provided with a shield shell for suppressing the radiation of electromagnetic noise to outside from the connector. Such a connector may be mounted in a mounting hole provided in the case, for example, as described in Patent Document 1. A connector described in Patent Document 1 includes a connector housing in which a terminal electrically connected to an end part of a wire is arranged. The connector housing includes an inserting portion to be inserted into a mounting hole and an outer arrangement portion integral with the inserting portion and to be arranged outside the case. The wire is pulled out to the outside of the connector housing from the outer arrangement portion. The outer arrangement portion has the outer periphery thereof covered by a shield shell. The shield shell is electrically connected to the case by coming into contact with the case. Further, the shield shell is fixed to the case while being held in contact with an outer peripheral part of an outer opening of the mounting hole in the case. The wire pulled out to the outside of the connector housing from the outer arrangement portion is covered by a shield conductor including a braided wire to be electrically connected to the shield shell. A shield-side sealing member for sealing between the shield shell and the connector housing is arranged between the outer peripheral surface of the outer arrangement portion and the inner peripheral surface of the shield shell. The shield-side sealing member has an annular shape and is externally fit to the outer arrangement portion. The shield-side sealing member suppresses the intrusion of a liquid having intruded into between the outer peripheral surface of the outer arrangement portion and the inner peripheral surface of the shield shell through a clearance between the outer peripheral part of the outer opening of the mounting hole in the case and the shield shell in contact with this outer peripheral part into the shield conductor through a clearance between the outer peripheral surface of the outer arrangement portion and the inner peripheral surface of the shield shell.

PRIOR ART DOCUMENT

Patent Document

Patent Document 1: JP 2012-226948 A

SUMMARY OF THE INVENTION

Problems to be Solved

Since a vehicle travels in various environment places, a liquid trying to intrude into the clearance between the outer peripheral surface of the outer arrangement portion of the connector and the inner peripheral surface of the shield shell may include a salt content. In this case, the liquid including the salt content contacts the shield-side sealing member for sealing between the outer peripheral surface of the outer arrangement portion and the inner peripheral surface of the shield shell. Then, the aged deterioration of the shield-side sealing member is promoted by the salt content included in the liquid, whereby the sealing property of the shield-side sealing member may be reduced.

The present disclosure aims to provide a connector capable of suppressing a reduction in the sealing property of a shield-side sealing member between a shield shell and a connector housing due to the contact of a liquid including a salt content.

Means to Solve the Problem

The present disclosure is directed to a connector with a connector housing including an inserting portion to be inserted into a mounting hole provided in a conductive case for accommodating a device to be installed in a vehicle and an outer arrangement portion integral with the inserting portion and to be arranged outside the case, a terminal electrically connected to an end part of a wire being arranged inside the connector housing, a shield shell including a tubular covering portion for covering an outer periphery of the outer arrangement portion, the shield shell being electrically connected to the case, and a shield-side sealing member for sealing between an outer peripheral surface of the outer arrangement portion and an inner peripheral surface of the covering portion, at least one of a facing surface of the covering portion facing the connector housing or the case and the outer peripheral surface of the outer arrangement portion having a groove provided over the entire outer periphery of the outer arrangement portion between the shield-side sealing member and the inserting portion.

Effect of the Invention

According to the connector of the present disclosure, it is possible to suppress a reduction in the sealing property of the shield-side sealing member between the shield shell and the connector housing due to the contact of a liquid including a salt content.

DETAILED DESCRIPTION TO EXECUTE THE INVENTION

Description of Embodiments of Present Disclosure

Figure 1:
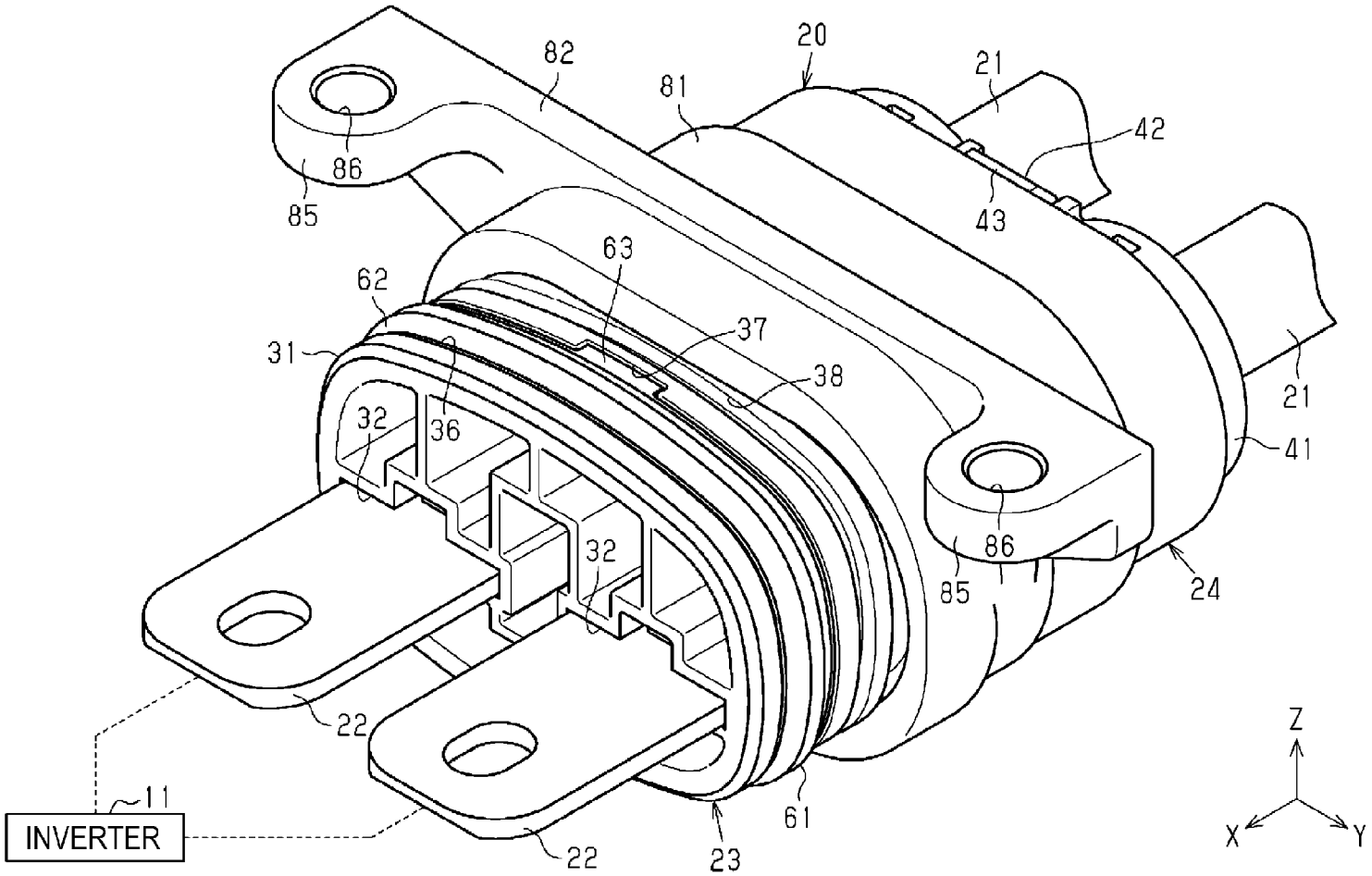
FIG. 1 is a perspective view of a connector in one embodiment.

First, embodiments of the present disclosure are listed and described.

(1) The connector of the present disclosure is provided with a connector housing including an inserting portion to be inserted into a mounting hole provided in a conductive case for accommodating a device to be installed in a vehicle and an outer arrangement portion integral with the inserting portion and to be arranged outside the case, a terminal electrically connected to an end part of a wire being arranged inside the connector housing, a shield shell including a tubular covering portion for covering an outer periphery of the outer arrangement portion, the shield shell being electrically connected to the case, and a shield-side sealing member for sealing between an outer peripheral surface of the outer arrangement portion and an inner peripheral surface of the covering portion, at least one of a facing surface of the covering portion facing the connector housing or the case and the outer peripheral surface of the outer arrangement portion having a groove provided over the entire outer periphery of the outer arrangement portion between the shield-side sealing member and the inserting portion.

According to the above aspect, a liquid such as water having intruded into between the outer peripheral surface of the outer arrangement portion and the inner peripheral surface of the covering portion from an end of the covering portion on the side of the inserting portion can be accumulated in the groove before reaching the shield-side sealing member. Accordingly, it becomes harder for the liquid to move toward the shield-side sealing member before the liquid is filled up in the groove. Thus, it becomes harder for a liquid such as water including a salt content to contact the shield-side sealing member, wherefore it is suppressed that the aged deterioration of the shield-side sealing member is promoted due to the liquid. As a result, a reduction in the sealing property of the shield-side sealing member between the shield shell and the connector housing due to the contact of the liquid including the salt content can be suppressed.

(2) Preferably, the groove is provided at least in the outer peripheral surface of the outer arrangement portion.

According to the above aspect, a reduction in the sealing property of the shield-side sealing member due to the contact of the liquid including the salt content can be suppressed by the groove provided in the outer peripheral surface of the outer arrangement portion. Further, the groove provided in the outer peripheral surface of the outer arrangement portion is easily formed as compared to a groove provided in the facing surface of the covering portion.

(3) Preferably, the groove provided in the outer peripheral surface of the outer arrangement portion overlaps an end surface of the covering portion on the side of the inserting portion in a facing direction of the outer peripheral surface of the outer arrangement portion and the inner peripheral surface of the covering portion.

According to the above aspect, at least part of the liquid having intruded into the groove provided in the outer peripheral surface of the outer arrangement portion is easily discharged to the outside of the connector along the end surface of the covering portion on the side of the inserting portion after flowing vertically downward along the groove. Thus, it can be more suppressed that a liquid such as water including a salt content reaches the shield-side sealing member, wherefore it is more suppressed that the aged deterioration of the shield-side sealing member is promoted due to the liquid. As a result, a reduction in the sealing property of the shield-side sealing member due to the contact of the liquid including the salt content can be more suppressed.

(4) Preferably, the end surface of the covering portion on the side of the inserting portion is the facing surface facing the case, and the groove is provided in the end surface of the covering portion on the side of the inserting portion.

According to the above aspect, at least part of the liquid having intruded into between the outer peripheral surface of the outer arrangement portion and the inner peripheral surface of the covering portion from a clearance between the end surface of the covering portion on the side of the inserting portion and the case can intrude into the groove provided in the end surface of the covering portion on the side of the inserting portion before reaching the clearance between the outer peripheral surface of the outer arrangement portion and the inner peripheral surface of the covering portion. The liquid having intruded into the groove can be discharged to the outside of the connector from the clearance between the end surface of the covering portion on the side of the inserting portion and the case after flowing vertically downward along the groove. As just described, at least part of the liquid trying to intrude into between the outer peripheral surface of the outer arrangement portion and the inner peripheral surface of the covering portion can be discharged to the outside of the connector before reaching the clearance between the outer peripheral surface of the outer arrangement portion and the inner peripheral surface of the covering portion. Thus, it can be more suppressed that a liquid such as water including a salt content reaches the shield-side sealing member, wherefore it is more suppressed that the aged deterioration of the shield-side sealing member is promoted due to the liquid. As a result, a reduction in the sealing property of the shield-side sealing member due to the contact of the liquid including the salt content can be more suppressed.

(5) Preferably, an end part of the covering portion on the side of the inserting portion includes a cut portion penetrating through the end part of the covering portion on the side of the inserting portion in the facing direction of the outer peripheral surface of the outer arrangement portion and the inner peripheral surface of the covering portion, and the cut portion communicates with the groove provided in the end surface of the covering portion on the side of the inserting portion.

According to the above aspect, if the connector is so mounted into the case that the cut portion is arranged to extend vertically downward rather than being arranged in a horizontal direction, the liquid having intruded into the groove provided in the end surface of the covering portion on the side of the inserting portion is easily discharged to the outside of the connector from the cut portion. Accordingly, it can be more suppressed that the liquid trying to intrude into between the outer peripheral surface of the outer arrangement portion and the inner peripheral surface of the covering portion reaches the clearance between the outer peripheral surface of the outer arrangement portion and the inner peripheral surface of the covering portion. Thus, it can be further suppressed that a liquid such as water including a salt content reaches the shield-side sealing member, wherefore it is further suppressed that the aged deterioration of the shield-side sealing member is promoted due to the liquid. As a result, a reduction in the sealing property of the shield-side sealing member due to the contact of the liquid including the salt content can be further suppressed.

Details of Embodiment of Present Disclosure

A specific example of a connector of the present disclosure is described below with reference to the drawings. Note that the present invention is not limited to these illustrations and is intended to be represented by claims and include all changes in the scope of claims and in the meaning and scope of equivalents.

One embodiment of the connector is described below.

Figure 2:
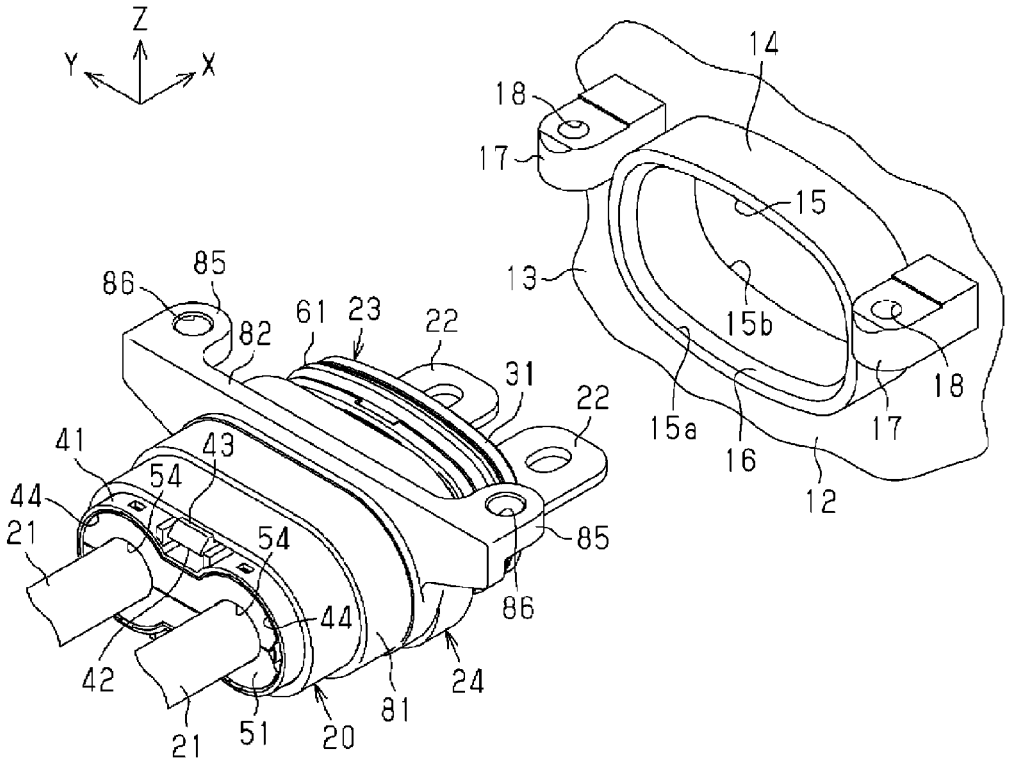
FIG. 2 is an exploded perspective view of the connector and a case in the one embodiment.

A connector 20 of this embodiment shown in FIGS. 1 and 2 is used to electrically connect an inverter 11 to be installed in an automotive vehicle and an unillustrated battery. The connector 20 is mounted into a conductive case 12 accommodating the inverter 11. In this embodiment, the inverter 11 corresponds to a "device".

As shown in FIG. 2, the case 12 of this embodiment is made of a conductive metal material. The case 12 includes a box-shaped case body 13 for accommodating the inverter 11 and a flat tubular mounting portion 14 integral with the case body 13 and projecting outwardly of the case body 13. The mounting portion 14 has a tubular shape by having a mounting hole 15 penetrating through the mounting portion 14. The mounting hole 15 has a flat shape having a long direction and a short direction when viewed from a penetration direction of the mounting hole 15.

The connector 20 is mountable into the case 12 in an arbitrary orientation corresponding to the posture of the mounting portion 14. However, in this embodiment, the connector 20 is described with the penetration direction of the mounting hole 15 defined as a front-rear direction. In FIG. 2, an X direction is the penetration direction of the mounting hole 15 and a direction from an outer opening 15*a* toward an inner opening 15*b* of the mounting hole 15. Further, a Y direction is one direction perpendicular to the penetration direction X of the mounting hole 15 and along the long direction of the mounting hole 15 and a leftward direction when the mounting portion 14 is viewed from a tip side. Furthermore, a Z direction is one direction perpendicular to the penetration direction X of the mounting hole 15 and along the short direction of the mounting hole 15 and an upward direction. In describing the directions for the connector 20, a front-rear direction X, a lateral direction Y and a vertical direction Z in a state where the connector 20 is mounted in the case 12 are used below.

The mounting hole 15 allows communication between the inside and outside of the case 12. The mounting hole 15 has a substantially rectangular shape with rounded corners when viewed from the side of the outer opening 15*a* thereof. Further, each of four inner side surfaces constituting the inner peripheral surface of the mounting hole 15 has an arc shape slightly bulging toward an outer peripheral side when viewed from the penetration direction X. The mounting hole 15 has, on the outer opening 15*a* thereof, an inclined surface 16 inclined to increase an opening area of the mounting hole 15 from an inner opening end side of the mounting hole 15 toward an outer opening end of the mounting hole 15. The inclined surface 16 is continuously formed over the entire periphery of the outer opening 15*a* of the mounting hole 15 and has an annular shape. The inclined surface 16 is inclined with respect to an inner peripheral surface extending in the penetration direction X of the mounting hole 15. Further, the inclined surface 16 is linearly inclined.

The case 12 includes fixing portions 17 for fixing the connector 20 to the case 12. In this embodiment, the case 12 includes two fixing portions 17. The two fixing portions 17 are provided on both sides in the lateral direction Y of the mounting portion 14 when viewed from the penetration direction X of the mounting hole 15. Each fixing portion 17 is integrally formed to the case body 13. Each fixing portion 17 is provided with a fixing hole 18 penetrating through each fixing portion 17 in the vertical direction Z.

Figure 4:
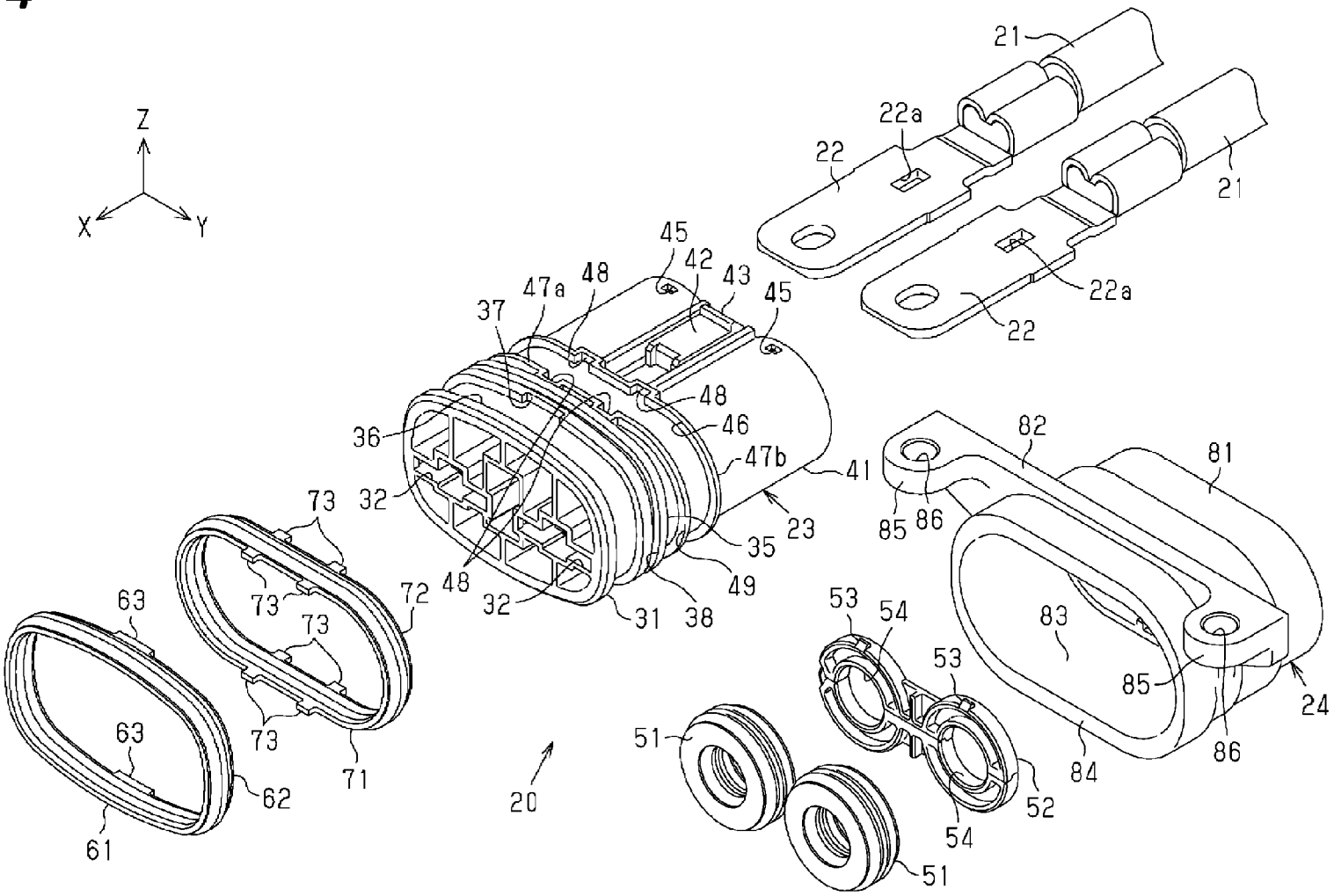
FIG. 4 is an exploded perspective view of the connector in the one embodiment.

As shown in FIGS. 1 and 4, the connector 20 includes a connector housing 23 in which two terminals 22 electrically connected to end parts of two wires 21 are arranged, and a shield shell 24 covering the connector housing 23 from outside.

Each terminal 22 is made of a conductive metal material. Each terminal 22 has a strip shape extending in the front-rear direction X. The wire 21 is electrically connected to a rear end part of each terminal 22. In this embodiment, the rear end part of the terminal 22 is crimped to an end part of the wire 21 to be connected to the terminal 22, whereby the wire 21 is electrically and mechanically connected to the terminal 22. Note that a method for electrically connecting the wire 21 and the terminal 22 is not limited to this and, for example, the wire 21 and the terminal 22 can also be electrically connected by ultrasonic welding. An end part of the wire 21 opposite to the terminal 22 is electrically connected to the unillustrated battery. A locking hole 22*a* penetrating through the terminal 22 in a thickness direction is provided in a substantially central part in the front-rear direction X of each terminal 22.

Figure 5:
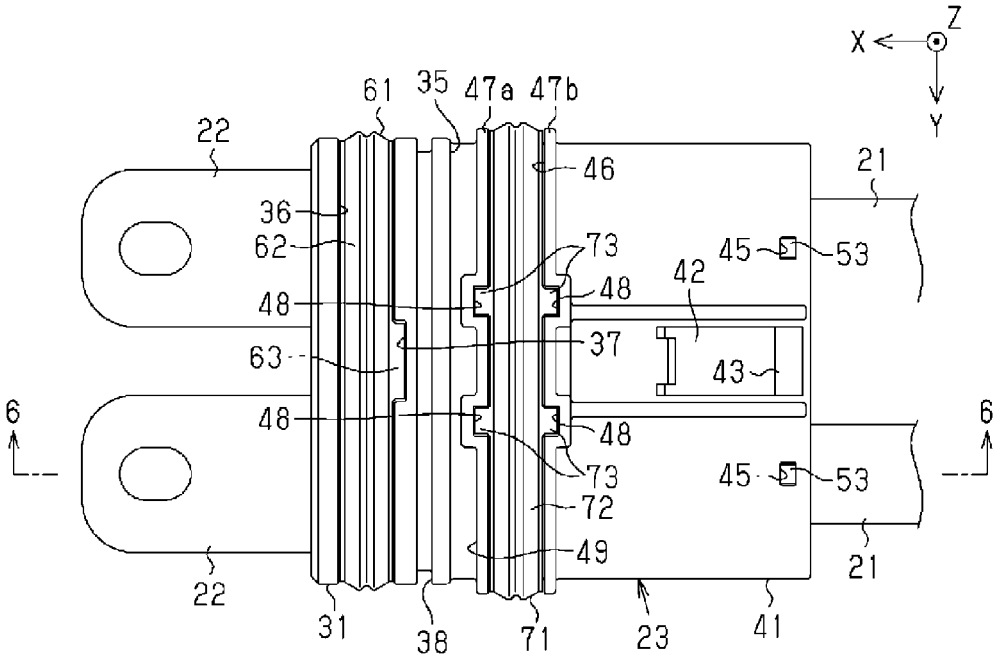
FIG. 5 is a plan view of the connector except a shield shell in the one embodiment.
Figure 6:
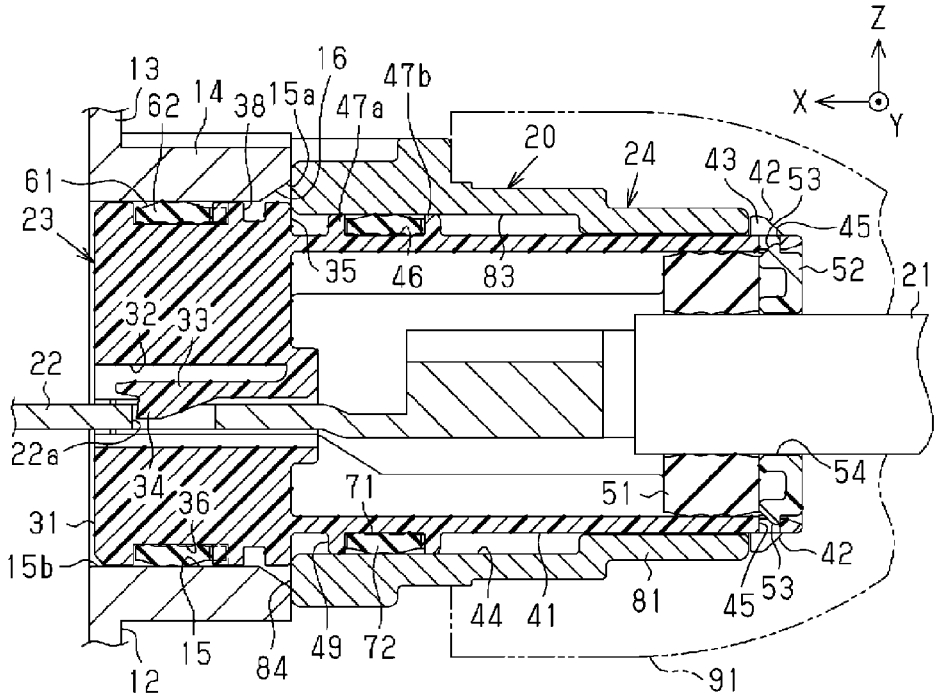
FIG. 6 is a section of the connector mounted in the case in the one embodiment.

As shown in FIGS. 4 and 6, the connector housing 23 is made of an insulating resin material. Note that FIG. 6 is a section of the connector 20 mounted in the case 12 cut along line 6-6 shown in FIG. 5. The connector housing 23 has a substantially tubular shape extending in the front-rear direction X. Further, the connector housing 23 has a flat shape long in the lateral direction Y (i.e. squeezed in the vertical direction Z). The connector housing 23 includes an inserting portion 31 to be inserted into the mounting hole 15 and an outer arrangement portion 41 integral with the inserting portion 31 and to be arranged outside the case 12.

The inserting portion 31 has a substantially tubular shape with an outer peripheral surface shaped to correspond to the inner peripheral surface of the mounting hole 15. The inserting portion 31 has a substantially rectangular shape with rounded corners long in the lateral direction Y when viewed from the front-rear direction X. Further, each of four outer side surfaces constituting the outer peripheral surface of the inserting portion 31 has an arc shape slightly bulging toward an outer peripheral side when viewed from the front-rear direction X.

The inserting portion 31 includes two holding holes 32 arranged in the lateral direction Y. Each holding hole 32 penetrates through the inserting portion 31 in the front-rear direction X. A locking piece 33 is provided inside each holding hole 32. In each holding hole 32, the locking piece 33 extends forward in parallel to the front-rear direction X after slightly projecting downward from the inner peripheral surface of a rear end part of the holding hole 32. Each locking piece 33 includes a locking projection 34 projecting downward therefrom. Each locking piece 33 is so resiliently deformable inside the holding hole 32 that a tip part of the locking piece 33 is shifted in the vertical direction Z with respect to a base end part of the locking piece 33.

The terminal 22 is inserted into each holding hole 32 from behind. The terminal 22 is arranged below the locking piece 33 inside the holding hole 32. The terminal 22 is held inside the holding hole 32 by fitting the locking projection 34 into the locking hole 22*a*. The two terminals 22 held inside the holding holes 32 are arranged while being spaced apart in a long direction of the inserting portion 31 when viewed from the front-rear direction X. Further, a thickness direction of the terminals 22 coincides with a short direction of the inserting portion 31.

The outer arrangement portion 41 extends rearward from the rear end of the inserting portion 31. The outer arrangement portion 41 has a substantially tubular shape long in the lateral direction Y when viewed from the front-rear direction X. A width in the vertical direction Z of the outer arrangement portion 41 is smaller than that of the inserting portion 31. An end part of the outer arrangement portion 41 on the side of the inserting portion 31 (front end part of the outer arrangement portion 41 in this embodiment) has a track shape (i.e. an athletic track shape) when viewed from the front-rear direction X. Further, the end part of the outer arrangement portion 41 on the side of the inserting portion 31 has an outer shape one size smaller than the outer shape of an end part of the inserting portion 31 on the side of the outer arrangement portion 41. When viewed from the front-rear direction X, the outer arrangement portion 41 is integrally provided in a center of the end part of the inserting portion 31 on the side of the outer arrangement portion 41 (rear end part of the inserting portion 31 in this embodiment). Thus, a step is formed in a boundary part between the rear end part of the inserting portion 31 and the front end part of the outer arrangement portion 41. An outer peripheral edge part of an end surface 35 of the inserting portion 31 on the side of the outer arrangement portion 41 (rear end surface of the inserting portion 31 in this embodiment) is exposed to surround the outer periphery of the front end part of the outer arrangement portion 41. The end surface 35 of the inserting portion 31 is in the form of a flat surface perpendicular to the front-rear direction.

A pair of locking claws 42 are integrally provided on the outer peripheral surface of the outer arrangement portion 41. One locking claw 42 is provided on each of both side surfaces of the outer arrangement portion 41 facing in the vertical direction Z. Each locking claw 42 extends rearward after projecting outward in the vertical direction Z from a substantially central part of the outer arrangement portion 41 in the lateral direction Y and in the front-rear direction X. Each locking claw 42 includes, on a tip part thereof the locking claw 42 (i.e. a rear end part of the locking claw 42), a locking projection 43 projecting toward a side opposite to the outer peripheral surface of the outer arrangement portion 41. Each locking claw 42 is so resiliently deformable that the tip part of the locking claw 42 is shifted in the vertical direction Z with respect to a base end part of the locking claw 42.

The outer arrangement portion 41 includes two accommodation holes 44 arranged in the lateral direction Y. The left accommodation hole 44 is provided behind the left holding hole 32 and connected to this holding hole 32. The right accommodation hole 44 is provided behind the right holding hole 32 and connected to this holding hole 32. A connecting part of the terminal 22 and the wire 21 is arranged inside the accommodation hole 44. That is, the rear end part of the terminal 22 and the end part of the wire 21 connected to the terminal 22 are arranged inside the accommodation hole 44. The wire 21 is pulled out to the outside of the connector housing 23 from the rear end of the accommodation hole 44.

An annular rubber plug 51 is mounted in a rear end part of each accommodation hole 44. The rubber plug 51 is fit in the rear end part of the accommodation hole 44 and externally fit to the wire 21. The outer peripheral surface of the rubber plug 51 is held in close contact with the inner peripheral surface of the accommodation hole 44 in a liquid-tight manner, and the inner peripheral surface of the rubber plug 51 is held in close contact with the outer peripheral surface of the wire 21 in a liquid-tight manner. In this way, the intrusion of a liquid such as water into the accommodation hole 44 from the rear end of the accommodation hole 44 is suppressed.

A back retainer 52 is fixed to a rear end part of the outer arrangement portion 41. The back retainer 52 is made of an insulating resin material. The back retainer 52 is in the form of a plate having a thickness direction aligned with the front-rear direction X. The back retainer 52 includes a plurality of (four in this embodiment) fixing claws 53 on the outer peripheral surface thereof. As many locking holes 45 as the fixing claws 53 are provided in the rear end part of the outer arrangement portion 41. The back retainer 52 is fixed to the outer arrangement portion 41 by respectively fitting the plurality of fixing claws 53 into the locking holes 45. The back retainer 52 is in contact with the rear end surface of the rubber plug 51. Further, the back retainer 52 includes two insertion holes 54 arranged in the lateral direction Y. Each wire 21 is pulled out to the outside of the connector housing 23 through the insertion hole 54.

Figure 3:
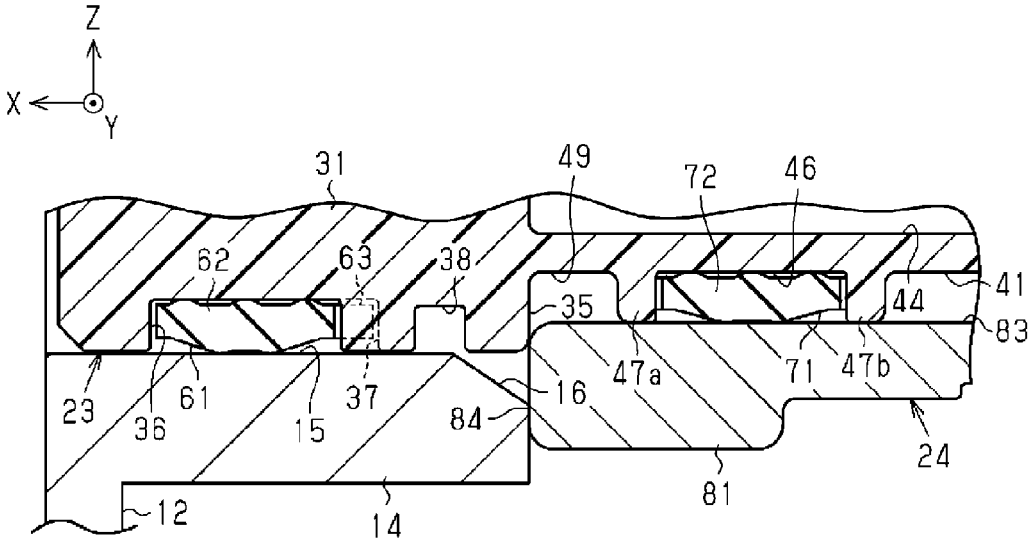
FIG. 3 is a partial enlarged section of the connector in the one embodiment.

As shown in FIGS. 3, 5 and 6, a first mounting groove 36 is recessed in the outer peripheral surface of the inserting portion 31. The first mounting groove 36 has an annular shape continuously extending over the entire periphery of the inserting portion 31 to surround the outer periphery of the inserting portion 31. The first mounting groove 36 has a rectangular cross-sectional shape perpendicular to an extending direction of the first mounting groove 36. Out of a pair of inner side surfaces of the first mounting groove 36 facing in the front-rear direction X, the rear inner surface is formed with positioning recesses 37. In this embodiment, one positioning recess 37 is provided in each of the upper and lower surfaces of the inserting portion 31. Each positioning recess 37 is recessed rearward from the rear inner side surface of the first mounting groove 36.

A case-side sealing member 61 is arranged in the first mounting groove 36. In this embodiment, the case-side sealing member 61 is a rubber ring. The case-side sealing member 61 includes an annular body portion 62 and positioning projections 63 projecting from the body portion 62. In this embodiment, the positioning projections 63 are provided at two positions at equal intervals in an extending direction of the body portion 62. The body portion 62 and the positioning projections 63 are integrally formed. The case-side sealing member 61 is so accommodated into the first mounting groove 36 that the body portion 62 is externally fit to the inserting portion 31. The case-side sealing member 61 is held in close contact with the bottom surface of the first mounting groove 36 in a liquid-tight manner. Further, the case-side sealing member 61 is positioned with respect to the inserting portion 31 in a relative rotation direction of the inserting portion 31 and the case-side sealing member 61 by respectively arranging a plurality of the positioning projections 63 into the positioning recesses 37.

The inserting portion 31 includes a first intrusion suppressing groove 38 continuously provided over the entire periphery of the inserting portion 31 in a part of the outer peripheral surface of the inserting portion 31 between the case-side sealing member 61 and the outer arrangement portion 41. In the outer peripheral surface of the inserting portion 31, the first intrusion suppressing groove 38 is provided in front of the end surface 35 of the inserting portion 31 and in a substantially central part in the front-rear direction X between the end surface 35 of the inserting portion 31 and the first mounting groove 36. The first intrusion suppressing groove 38 is recessed in the outer peripheral surface of the inserting portion 31 and has an annular shape continuously extending to surround the outer periphery of the inserting portion 31. In this embodiment, the first intrusion suppressing groove 38 has a rectangular cross-sectional shape perpendicular to an extending direction of the first intrusion suppressing groove 38 and is open toward an outer peripheral side of the inserting portion 31. Further, a width in the front-rear direction X of the first intrusion suppressing groove 38 is smaller than that of the first mounting groove 36. Furthermore, a depth of the first intrusion suppressing groove 38 is smaller than that of the first mounting groove 36. Note that the depth of the first intrusion suppressing groove 38 may be equal to or larger than that of the first mounting groove 36.

As shown in FIGS. 3 and 6, the inserting portion 31 is fit into the mounting hole 15 of the case 12. With the inserting portion 31 arranged in the mounting hole 15, the outer peripheral surface of the inserting portion 31 and the inner peripheral surface of the mounting hole 15 are facing in a direction perpendicular to the front-rear direction X. In this state, the case-side sealing member 61 is held in close contact with the bottom surface of the first mounting groove 36 and the inner peripheral surface of the mounting hole 15 in a liquid-tight manner. In this way, the case-side sealing member 61 seals between the outer peripheral surface of the inserting portion 31 and the inner peripheral surface of the mounting hole 15. Therefore, the intrusion of a liquid such as water into the case 12 through a clearance between the outer peripheral surface of the inserting portion 31 and the inner peripheral surface of the mounting hole 15 can be suppressed by the case-side sealing member 61.

Further, with the inserting portion 31 arranged in the mounting hole 15, the end surface 35 of the inserting portion 31 and the tip surface of the mounting portion 14 (rear end surface of the mounting portion 14 in this embodiment) are at the same position in the front-rear direction X. That is, the end surface 35 of the inserting portion 31 and the tip surface of the mounting portion 14 are located in the same plane perpendicular to the front-rear direction X. Note that although the end surface 35 of the inserting portion 31 and the tip surface of the mounting portion 14 are preferably located in the same plane perpendicular to the front-rear direction X, these surfaces may not be located in the same plane due to dimensional tolerances and the like. Further, "equal" in this specification also means to include slight differences of objects to be compared due to dimensional tolerances and the like besides meaning "exactly equal". The first intrusion suppressing groove 38 faces the inclined surface 16 of the mounting hole 15 in a facing direction of the outer peripheral surface of the inserting portion 31 and the inner peripheral surface of the mounting hole 15. In this embodiment, the rear end part of the first intrusion suppressing groove 38 and the front end part of the inclined surface 16 face and overlap in the facing direction of the outer peripheral surface of the inserting portion 31 and the inner peripheral surface of the mounting hole 15.

As shown in FIGS. 3, 5 and 6, a second mounting groove 46 is provided in the outer peripheral surface of the outer arrangement portion 41. A pair of mounting projections 47*a*, 47*b* are formed on the outer peripheral surface of the outer arrangement portion 41. Each mounting projection 47*a*, 47*b* projects toward the outer peripheral side of the outer arrangement portion 41 from the outer peripheral surface of the outer arrangement portion 41. Each mounting projection 47*a*, 47*b* is continuously provided over the entire periphery of the outer arrangement portion 41 and has an annular shape. Further, the mounting projections 47*a*, 47*b* are provided in parallel on the outer peripheral surface of the outer arrangement portion 41 while being spaced apart in the front-rear direction X. Further, the mounting projections 47*a*, 47*b* have an equal height from the outer peripheral surface of the outer arrangement portion 41. Furthermore, the mounting projections 47*a*, 47*b* are formed to have a constant height from the outer peripheral surface of the outer arrangement portion 41. The second mounting groove 46 is formed by this pair of mounting projections 47*a*, 47*b*. That is, a part between the mounting projections 47*a* and 47*b* serves as the second mounting groove 46. The second mounting groove 46 has an annular shape continuously extending over the entire periphery of the outer arrangement portion 41 to surround the outer periphery of the outer arrangement portion 41. The second mounting groove 46 has a rectangular cross-sectional shape perpendicular to an extending direction thereof.

The second mounting groove 46 includes positioning recesses 48 at a plurality of positions separated in the extending direction of the second mounting groove 46. The mounting projection 47*a* has parts rectangularly bent to project forward at a total of four positions including two positions on an upper end side of the outer arrangement portion 41 and two positions on a lower end side of the outer arrangement portion 41. Further, the mounting projection 47*b* has parts rectangularly bent to project rearward at a total of four positions including two positions on the upper end side of the outer arrangement portion 41 and two positions on the lower end side of the outer arrangement portion 41. The positioning recesses 48 are formed by inner peripheral surfaces of these rectangularly bent parts in the mounting projections 47*a*, 47*b*.

A shield-side sealing member 71 is arranged in the second mounting groove 46. In this embodiment, the shield-side sealing member 71 is a rubber ring. The shield-side sealing member 71 includes an annular body portion 72 and positioning projections 73 projecting from the body portion 72. In this embodiment, the positioning projections 73 are provided at four positions spaced apart in an extending direction of the body portion 72 on each of both widthwise sides of the body portion 72. The body portion 72 and the positioning projections 73 are integrally formed. The shield-side sealing member 71 is so accommodated into the second mounting groove 46 that the body portion 72 is externally fit to the outer arrangement portion 41. The shield-side sealing member 71 is held in close contact with the bottom surface of the second mounting groove 46 in a liquid-tight manner. Further, the shield-side sealing member 71 is positioned with respect to the outer arrangement portion 41 in a relative rotation direction of the outer arrangement portion 41 and the shield-side sealing member 71 by respectively arranging the plurality of positioning projections 73 into the positioning recesses 48.

Out of the pair of mounting projections 47*a*, 47*b*, the mounting projection 47*a* closer to the inserting portion 31, i.e. the mounting projection 47*a* located on a front side, is formed at a position separated from the inserting portion 31 toward an end part of the outer arrangement portion 41 opposite to the inserting portion 31. That is, the mounting projection 47*a* is formed at a position separated rearward from the end surface 35 of the inserting portion 31. Thus, a second intrusion suppressing groove 49 is formed in a part of the outer peripheral surface of the outer arrangement portion 41 closer to the inserting portion 31 than the mounting projection 47*a*. That is, the second intrusion suppressing groove 49 is a groove formed between the end surface 35 of the inserting portion 31 and the mounting projection 47*a*. As just described, the outer peripheral surface of the outer arrangement portion 41 includes the second intrusion suppressing groove 49 provided over the entire outer periphery of the outer arrangement portion 41 between the shield-side sealing member 71 and the inserting portion 31. The second intrusion suppressing groove 49 has an annular shape continuously extending to surround the outer periphery of the outer arrangement portion 41. In this embodiment, the second intrusion suppressing groove 49 has a rectangular cross-sectional shape perpendicular to an extending direction of the second intrusion suppressing groove 49 and is open toward the outer peripheral side of the outer arrangement portion 41. Further, a width in the front-rear direction X of the second intrusion suppressing groove 49 is smaller than that of the second mounting groove 46. Furthermore, a depth of the second intrusion suppressing groove 49 is equal to that of the second mounting groove 46. Note that the second intrusion suppressing groove 49 corresponds to a "groove" in this embodiment.

As shown in FIGS. 4 and 6, the shield shell 24 includes a tubular covering portion 81 for covering the outer periphery of the outer arrangement portion 41 and a fixing portion 82 integrally formed to the covering portion 81. The shield shell 24 is made of a conductive metal material.

The covering portion 81 has a flat shape long in the lateral direction Y corresponding to the outer shape of the outer arrangement portion 41. In this embodiment, the covering portion 81 has a track shape (i.e. an athletic track shape) when viewed from the front-rear direction X. A length in the front-rear direction X of the covering portion 81 is equal to a distance between the locking projections 43 of the locking claws 42 provided on the outer arrangement portion 41 and the end surface 35 of the inserting portion 31.

The inner peripheral surface of a rear end part of the covering portion 81 has a tubular shape having equal dimensions as the outer peripheral surface of the outer arrangement portion 41 (i.e. outer peripheral surface of the outer arrangement portion 41 except the mounting projections 47*a*, 47*b*). Further, the inner peripheral surface of the covering portion 81 in a part from a substantially central part in the front-rear direction to the front end of the covering portion 81 has a tubular shape having dimensions equal to outer dimeters of the mounting projections 47*a*, 47*b*.

The inner peripheral surface of the covering portion 81 is a first facing surface 83 facing the connector housing 23. An end surface of the covering portion 81 on the side of the inserting portion 31, i.e. the front end surface of the covering portion 81, is a second facing surface 84 facing the case 12 when the connector 20 is mounted into the case 12. In this embodiment, the second facing surface 84 is in the form of a flat surface perpendicular to the front-rear direction X.

The fixing portion 82 extends upward from a position of the covering portion 81 closer to a front end part of the covering portion 81 than a central part in the front-rear direction of the covering portion 81. A width in the lateral direction Y of the fixing portion 82 is larger than that of the covering portion 81. Connecting portions 85 projecting forward are respectively provided on both end parts in the lateral direction Y of the fixing portion 82. Each connecting portion 85 includes a fixing hole 86 penetrating through the connecting portion 85 in the vertical direction Z.

The shield shell 24 is externally fit to the outer arrangement portion 41 from behind the connector housing 23. The second facing surface 84 of the shield shell 24 comes into contact with the end surface 35 of the inserting portion 31 from behind, and the rear end surface of the covering portion 81 comes into contact with the locking projections 43. In this way, the shield shell 24 is positioned in the front-rear direction with respect to the connector housing 23. The covering portion 81 covers a part of the connector housing 23 between the end surface 35 of the inserting portion 31 and the locking projections 43. Further, with the inserting portion 31 fit in the mounting hole 15, the second facing surface 84 faces the tip surface of the mounting portion 14 in the front-rear direction. Furthermore, the second facing surface 84 comes into contact with the tip surface of the mounting portion 14.

As shown in FIG. 2, the two connecting portions 85 of the fixing portion 82 are fixed to the fixing portions 17 of the case 12 by unillustrated bolts and nuts inserted into the fixing holes 86, 18 after being overlaid on the fixing portions 17. In this way, the shield shell 24 is fixed to the case 12 and electrically connected to the case 12.

As shown in FIGS. 3 and 6, the first facing surface 83 and the outer peripheral surface of the outer arrangement portion 41 face in the direction perpendicular to the front-rear direction X inside the covering portion 81. Further, the shield-side sealing member 71 is held in close contact with the inner peripheral surface of the covering portion 81 and the bottom surface of the second mounting groove 46 inside the covering portion 81. In this way, the shield-side sealing member 71 seals between the outer peripheral surface of the outer arrangement portion 41 and the inner peripheral surface of the covering portion 81. Therefore, the intrusion of a liquid such as water toward the wires 21 pulled out from the connector housing 23 through a clearance between the outer peripheral surface of the outer arrangement portion 41 and the inner peripheral surface of the covering portion 81 is suppressed by the shield-side sealing member 71.

Further, with the shield shell 24 mounted on the connector housing 23, the second intrusion suppressing groove 49 overlaps an end surface (second facing surface 84 in this embodiment) of the covering portion 81 on the side of the inserting portion 31 in a facing direction of the outer peripheral surface of the outer arrangement portion 41 and the inner peripheral surface of the covering portion 81. That is, the second facing surface 84 is within a range of the second intrusion suppressing groove 49 in the front-rear direction X. In this embodiment, the front end of the second intrusion suppressing groove 49 and the second facing surface 84 overlap in the facing direction of the outer peripheral surface of the outer arrangement portion 41 and the inner peripheral surface of the covering portion 81. Note that the facing direction of the outer peripheral surface of the outer arrangement portion 41 and the inner peripheral surface of the covering portion 81 is the same as the direction perpendicular to the front-rear direction X.

The wires 21 pulled out to the outside of the connector housing 23 from the rear end of the connector housing 23 are collectively covered by a shield conductor 91. The shield conductor 91 includes an unillustrated conductive braided wire to be electrically connected to a rear end part of the covering portion 81 and a conductive shield pipe to be electrically connected to a rear end part of the braided wire.

The two wires 21 are arranged inside the braided wire and the shield pipe.

Functions of this embodiment are described.

If a liquid such as water splashes on the connector 20, part of the liquid may intrude into between the outer peripheral surface of the outer arrangement portion 41 and the inner peripheral surface of the covering portion 81 through a clearance between the tip surface of the mounting portion 14 and the second facing surface 84 of the covering portion 81. Note that since the vehicle installed with the inverter 11 travels in various environment places, the liquid may include a salt content. If the liquid having intruded into between the outer peripheral surface of the outer arrangement portion 41 and the inner peripheral surface of the covering portion 81 moves toward the shield-side sealing member 71, the liquid possibly enters the second intrusion suppressing groove 49 before reaching the shield-side sealing member 71. Any further movement of the liquid toward the shield-side sealing member 71 is suppressed by the liquid entering the second intrusion suppressing groove 49.

The liquid having entered the second intrusion suppressing groove 49 flows vertically downward in the second intrusion suppressing groove 49. Thereafter, the liquid can be discharged to the outside of the connector 20 from the clearance between the tip surface of the mounting portion 14 and the second facing surface 84 of the covering portion 81 in a lower part of the connector housing 23. At this time, the second intrusion suppressing groove 49 overlaps the second facing surface 84 of the covering portion 81 in the facing direction of the outer peripheral surface of the outer arrangement portion 41 and the inner peripheral surface of the covering portion 81. Thus, the liquid in the second intrusion suppressing groove 49 can be easily discharged to the outside of the connector 20 from a clearance between a part of the second facing surface 84 located below the second intrusion suppressing groove 49 and the tip surface of the mounting portion 14 in the lower part of the connector housing 23.

Effects of this embodiment are described.

(1) A liquid such as water having intruded into between the outer peripheral surface of the outer arrangement portion 41 and the inner peripheral surface of the covering portion 81 from the end of the covering portion 81 on the side of the inserting portion 31 can be accumulated in the second intrusion suppressing groove 49 before reaching the shield-side sealing member 71. Accordingly, it becomes harder for the liquid to move toward the shield-side sealing member 71 before the liquid is filled up in the second intrusion suppressing groove 49. Thus, it becomes harder for a liquid such as water including a salt content to contact the shield-side sealing member 71, wherefore it is suppressed that the aged deterioration of the shield-side sealing member 71 is promoted due to the liquid. As a result, a reduction in the sealing property of the shield-side sealing member 71 between the shield shell 24 and the connector housing 23 due to the contact of the liquid including the salt content can be suppressed.

(2) A reduction in the sealing property of the shield-side sealing member 71 due to the contact of the liquid including the salt content can be suppressed by the second intrusion suppressing groove 49 provided in the outer peripheral surface of the outer arrangement portion 41. Further, the outer arrangement portion 41 is made of a resin material. Furthermore, the second intrusion suppressing groove 49 provided in the outer peripheral surface of the outer arrangement portion 41 is open toward the outer peripheral side of the outer arrangement portion 41. Accordingly, the second intrusion suppressing groove 49 provided in the outer peripheral surface of the outer arrangement portion 41 is easily formed as compared to second intrusion suppressing grooves (corresponding to the "groove") provided in the first and second facing surfaces 83, 84 of the covering portion 81.

(3) The second intrusion suppressing groove 49 overlaps the second facing surface 84 of the covering portion 81 in the facing direction of the outer peripheral surface of the outer arrangement portion 41 and the inner peripheral surface of the covering portion 81. Thus, part of the liquid having intruded into the second intrusion suppressing groove 49 is easily discharged to the outside of the connector 20 along the end surface of the covering portion 81 on the side of the inserting portion 31 after flowing vertically downward along the second intrusion suppressing groove 49. Accordingly, it can be more suppressed that a liquid such as water including a salt content reaches the shield-side sealing member 71, wherefore it is more suppressed that the aged deterioration of the shield-side sealing member 71 is promoted due to the liquid. As a result, a reduction in the sealing property of the shield-side sealing member 71 due to the contact of the liquid including the salt content can be suppressed.

This embodiment can be modified as follows. This embodiment and the following modifications can be combined with each other without technically contradicting each other.

At least one of the first facing surface 83 of the covering portion 81 facing the connector housing 23 and the second facing surface 84 of the covering portion 81 facing the case 12 may include a second intrusion suppressing groove (corresponding to the "groove") provided over the entire outer periphery of the outer arrangement portion 41 between the shield-side sealing member 71 and the inserting portion 31.

Figure 7:
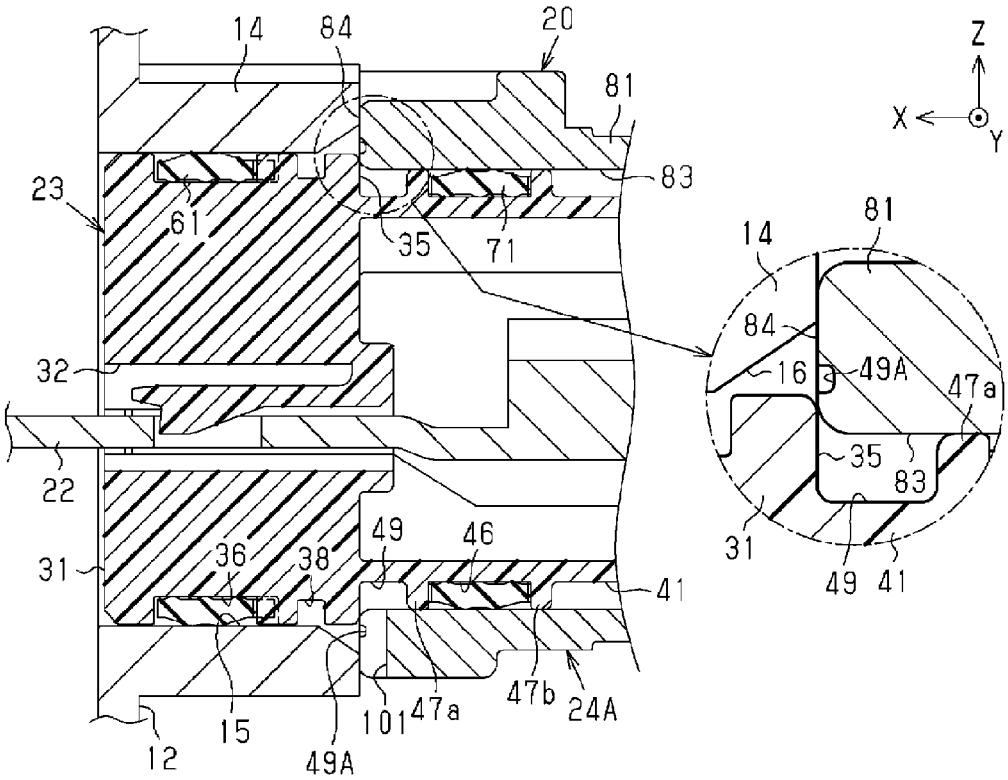
FIG. 7 is a section of a connector mounted in the case in a modification.
Figure 8:
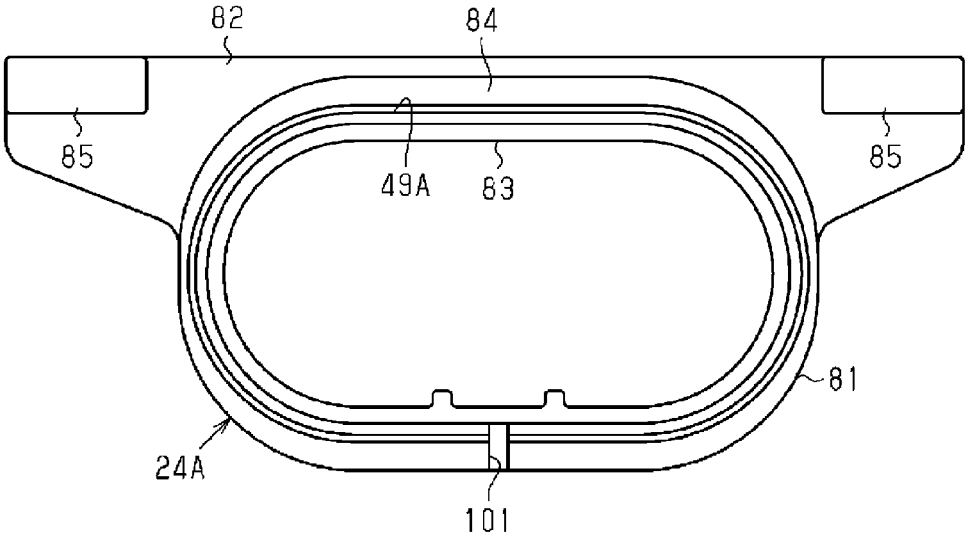
FIG. 8 is a front view of a shield shell in the modification.
Figure 9:
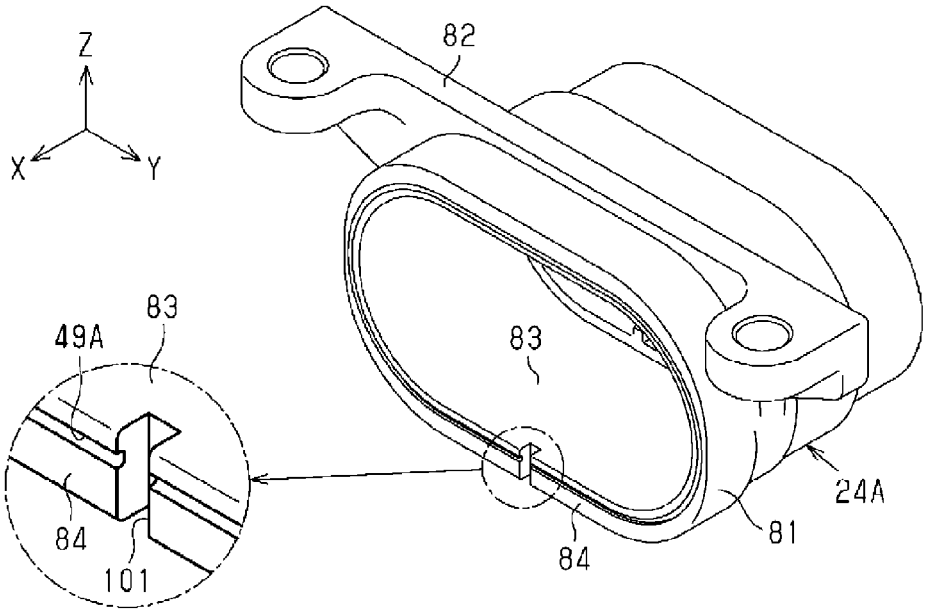
FIG. 9 is a perspective view of the shield shell in the modification.

For example, as shown in FIGS. 7, 8 and 9, a shield shell 24A provided in the connector 20 instead of the shield shell 24 of the above embodiment is configured by adding a second intrusion suppressing groove 49A corresponding to the "groove" and a cut portion 101 to the shield shell 24 of the above embodiment. The second intrusion suppressing groove 49A is provided in the second facing surface 84 of the covering portion 81. The second intrusion suppressing groove 49A is continuously provided over the entire outer periphery of the outer arrangement portion 41 to surround an end part of the outer arrangement portion 41 on the side of the inserting portion 31 between the shield-side sealing member 71 and the inserting portion 31. The second intrusion suppressing groove 49A is an annular groove recessed rearward from the second facing surface 84.

The end part of the covering portion 81 on the side of the inserting portion 31 includes the cut portion 101. The cut portion 101 penetrates through the end part of the covering portion 81 on the side of the inserting portion 31 in the facing direction of the outer peripheral surface of the outer arrangement portion 41 and the inner peripheral surface of the covering portion 81. Further, the cut portion 101 communicates with the second intrusion suppressing groove 49A. Further, in this modification, the cut portion 101 is provided in a center part in the lateral direction Y of a lower end part of the covering portion 81. The cut portion 101 is provided at a vertically lower position of the connector 20 with the connector 20 mounted in the case 12. Further, the cut portion 101 overlaps the second intrusion suppressing groove 49 in the facing direction of the outer peripheral surface of the outer arrangement portion 41 and the inner peripheral surface of the covering portion 81. That is, in this modification, the cut portion 101 is located vertically below the second intrusion suppressing groove 49 with the connector 20 mounted in the case 12.

By this arrangement, at least part of the liquid trying to intrude into between the outer peripheral surface of the outer arrangement portion 41 and the inner peripheral surface of the covering portion 81 through the clearance between the second facing surface 84 of the covering portion 81 and the tip surface of the mounting portion 14 can intrude into the second intrusion suppressing groove 49A provided in the second facing surface 84 before reaching the clearance between the outer peripheral surface of the outer arrangement portion 41 and the inner peripheral surface of the covering portion 81. The liquid having intruded into the second intrusion suppressing groove 49A can be discharged to the outside of the connector 20 through the clearance between the second facing surface 84 and the tip surface of the mounting portion 14 after flowing vertically downward along the second intrusion suppressing groove 49A. As just described, the liquid trying to intrude into between the outer peripheral surface of the outer arrangement portion 41 and the inner peripheral surface of the covering portion 81 can be discharged to the outside of the connector 20 before reaching the clearance between the outer peripheral surface of the outer arrangement portion 41 and the inner peripheral surface of the covering portion 81. Thus, it can be more suppressed that a liquid such as water including a salt content reaches the shield-side sealing member 71, wherefore it is more suppressed that the aged deterioration of the shield-side sealing member 71 is promoted due to the liquid. As a result, a reduction in the sealing property of the shield-side sealing member 71 due to the contact of the liquid including the salt content can be more suppressed.

Further, if the connector 20 is so mounted into the case 12 that the cut portion 101 is arranged to extend vertically downward rather than being arranged in a horizontal direction, the liquid having intruded into the second intrusion suppressing groove 49A is easily discharged to the outside of the connector 20 from the cut portion 101. Accordingly, it can be more suppressed that the liquid trying to intrude into between the outer peripheral surface of the outer arrangement portion 41 and the inner peripheral surface of the covering portion 81 reaches the clearance between the outer peripheral surface of the outer arrangement portion 41 and the inner peripheral surface of the covering portion 81. Thus, it can be further suppressed that a liquid such as water including a salt content reaches the shield-side sealing member 71, wherefore it is further suppressed that the aged deterioration of the shield-side sealing member 71 is promoted due to the liquid. As a result, a reduction in the sealing property of the shield-side sealing member 71 due to the contact of the liquid including the salt content can be further suppressed.

Figure 10:
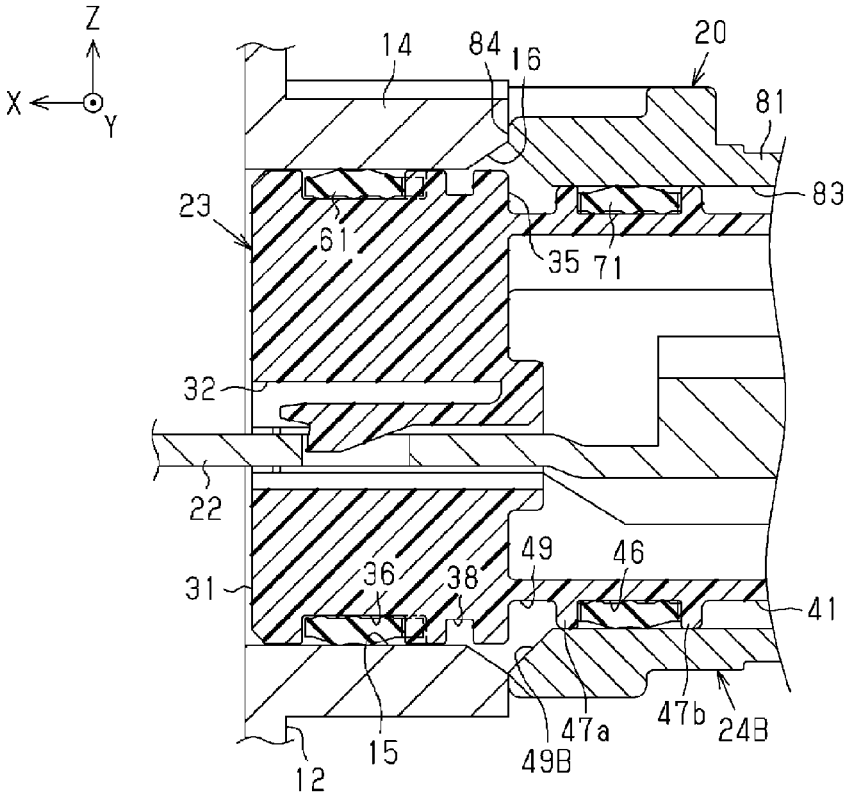
FIG. 10 is a section of a connector mounted in the case in the modification.

For example, as shown in FIG. 10, a shield shell 24B provided in the connector 20 instead of the shield shell 24 of the above embodiment is configured by adding a second intrusion suppressing groove 49B corresponding to the "groove" to the shield shell 24 of the above embodiment. The second intrusion suppressing groove 49B is provided in the second facing surface 84 of the covering portion 81. The second intrusion suppressing groove 49B is continuously provided over the entire outer periphery of the outer arrangement portion 41 to surround the end part of the outer arrangement portion 41 on the side of the inserting portion 31 between the shield-side sealing member 71 and the inserting portion 31. This second intrusion suppressing groove 49B is an annular groove recessed rearward from the second facing surface 84. The second intrusion suppressing groove 49B is formed to become gradually deeper in the front-rear direction from an outer peripheral end of the second intrusion suppressing groove 49B toward an inner peripheral end of the second intrusion suppressing groove 49B. The inner surface of the second intrusion suppressing groove 49B is inclined to increase an opening area of an opening of the covering portion 81 on the side of the second facing surface 84 toward the second facing surface 84 along the front-rear direction. Further, the second intrusion suppressing groove 49B is facing the second intrusion suppressing groove 49 in the facing direction of the outer peripheral surface of the outer arrangement portion 41 and the inner peripheral surface of the covering portion 81.

By this arrangement, part of the liquid having intruded into the second intrusion suppressing groove 49 can be discharged downward of the connector 20 in the vertical direction through the clearance between the second facing surface 84 of the covering portion 81 and the tip surface of the mounting portion 14 after flowing vertically downward along the second intrusion suppressing groove 49 or 49B. At that time, the liquid is guided downward of the connector 20 in the vertical direction on and along the inner surface of the second intrusion suppressing groove 49B in a lower end part of the connector 20. Thus, the liquid is easily discharged to the outside of the connector 20. Therefore, a movement of the liquid having intruded into between the second facing surface 84 of the covering portion 81 and the tip surface of the mounting portion 14 toward the shield-side sealing member 71 can be more suppressed. As a result, a reduction in the sealing property of the shield-side sealing member 71 due to the contact of the liquid including the salt content can be suppressed.

For example, a second intrusion suppressing groove corresponding to the "groove" provided over the entire outer periphery of the outer arrangement portion 41 may be provided in the first facing surface 83 of the covering portion 81 between the shield-side sealing member 71 and the inserting portion 31. In this case, the second intrusion suppressing groove may be, for example, an annular groove recessed toward the outer peripheral side of the covering portion 81 from the first facing surface 83 and continuously extending over the entire periphery of the covering portion 81.

Note that if the second intrusion suppressing groove is provided in at least one of the first and second facing surfaces 83, 84, the outer peripheral surface of the outer arrangement portion 41 may not necessarily include the second intrusion suppressing groove 49. In this case, the mounting projection 47*a* may be omitted and the shield-side sealing member 71 and the mounting projection 47*b* may be shifted forward so that the shield-side sealing member 71 is positioned in the front-rear direction by the end surface 35 of the inserting portion 31 and the mounting projection 47*b*.

In the above embodiment, the second intrusion suppressing groove 49 overlaps the second facing surface 84 of the covering portion 81 in the facing direction of the outer peripheral surface of the outer arrangement portion 41 and the inner peripheral surface of the covering portion 81. However, the second intrusion suppressing groove 49 provided in the outer peripheral surface of the outer arrangement portion 41 and the second facing surface 84 may deviate in the front-rear direction.

An auxiliary sealing member for sealing between the outer peripheral surface of the outer arrangement portion 41 and the inner peripheral surface of the covering portion 81 may be arranged in the second intrusion suppressing groove 49. The auxiliary sealing member has only to be a member to be held in close contact with the outer peripheral surface of the outer arrangement portion 41 and the inner peripheral surface of the covering portion 81 in a liquid-tight manner. The auxiliary sealing member is, for example, a rubber ring. By this arrangement, it can be further suppressed by the auxiliary sealing member arranged in the second intrusion suppressing groove 49 that the liquid having intruded into between the outer peripheral surface of the outer arrangement portion 41 and the inner peripheral surface of the covering portion 81 reaches the shield-side sealing member 71. Therefore, it is more suppressed that the aged deterioration of the shield-side sealing member 71 is promoted due to the liquid. As a result, a reduction in the sealing property of the shield-side sealing member 71 due to the contact of the liquid including the salt content can be more suppressed.

In the above embodiment, the outer peripheral surface of the outer arrangement portion 41 has only one second intrusion suppressing groove 49. However, the outer peripheral surface of the outer arrangement portion 41 may have a plurality of second intrusion suppressing grooves 49. If at least one of the first facing surface 83 of the covering portion 81 and the second facing surface 84 of the covering portion 81 similarly has a second intrusion suppressing groove, this facing surface may have a plurality of second intrusion suppressing grooves. By this arrangement, a liquid trying to intrude into between the outer peripheral surface of the outer arrangement portion 41 and the inner peripheral surface of the covering portion 81 through the clearance between the tip surface of the covering portion 14 and the second facing surface 84 of the covering portion 81 can be accumulated in the plurality of second intrusion suppressing grooves before reaching the shield-side sealing member 71. Accordingly, it is more easily suppressed that the liquid trying to intrude into between the outer peripheral surface of the outer arrangement portion 41 and the inner peripheral surface of the covering portion 81 through the clearance between the tip surface of the covering portion 14 and the second facing surface 84 of the covering portion 81 reaches the shield-side sealing member 71. As a result, a reduction in the sealing property of the shield-side sealing member 71 due to the contact of a liquid including a salt content can be even more suppressed.

The shape of the second intrusion suppressing groove 49 formed in the outer peripheral surface of the outer arrangement portion 41 is not limited to that of the above embodiment. The second intrusion suppressing groove 49 has only to be continuously provided over the entire periphery of the outer arrangement portion 41 in a part of the outer peripheral surface of the outer arrangement portion 41 between the shield-side sealing member 71 and the inserting portion 31. For example, the second intrusion suppressing groove 49 may have another cross-sectional shape perpendicular to the extending direction of the second intrusion suppressing groove 49 such as an arcuate or polygonal cross-sectional shape rather than a rectangular cross-sectional shape. In the above embodiment, the second intrusion suppressing groove 49 is in the form of a groove in the outer peripheral surface of the outer arrangement portion 41 by providing the mounting projection 47*a* on the outer peripheral surface of the outer arrangement portion 41. However, the second intrusion suppressing groove 49 may be a groove recessed inward from the outer peripheral surface of the outer arrangement portion 41. Further, the second intrusion suppressing groove 49 may be shallower or deeper than the second mounting groove 46.

The shape of the mounting hole 15 is not limited to that of the above embodiment. For example, the mounting hole 15 may not have the inclined surface 16. The shape of the inserting portion 31 is not limited to that of the above embodiment and the inserting portion 31 has only to be formed to have an outer shape fittable into the mounting hole 15 according to the shape of the mounting hole 15.

The shape of the inserting portion 31 is not limited to that of the above embodiment. For example, the inserting portion 31 may not necessarily include the first intrusion suppressing groove 38.

The shape of the shield shell 24 is not limited to that of the above embodiment if the shield shell 24 is shaped to include the tubular covering portion 81 for covering the outer periphery of the outer arrangement portion 41. The covering portion 81 may have a shape different from that of the above embodiment if the covering portion 81 is shaped to be able to cover the outer periphery of the outer arrangement portion 41.

The shape of the shield-side sealing member 71 is not limited to that of the above embodiment and has only to be shaped to be able to seal between the outer peripheral surface of the outer arrangement portion 41 and the inner peripheral surface of the covering portion 81. For example, the shield-side sealing member 71 may not include the positioning projections 73. Further, besides a rubber plug, a member capable of sealing between the outer peripheral surface of the outer arrangement portion 41 and the inner peripheral surface of the covering portion 81 may be used as the shield-side sealing member 71.

One, three or more terminals 22 may be arranged inside the connector housing 23. The number of the wires 21 can also be changed according to the number of the terminals 22.

In the above embodiment, the connector 20 is described using the inverter 11 as an example of the device to be installed in the vehicle. However, the device is not limited to an inverter. For example, the device may be a motor. That is, the connector 20 may be used to electrically connect the motor and the battery.

The second intrusion suppressing groove 49 of the connector housing 23 of the embodiment is an example of a first annular groove-like liquid buffer zone having a liquid storage space capable of temporarily storing or holding a liquid. The second intrusion suppressing groove 49A of the shield shell 24 of the embodiment is an example of a second annular groove-like liquid buffer zone having a liquid storage space capable of temporarily storing or holding a liquid.

The mounting projection 47*a* of the embodiment is an example of a barrier wall provided between the second mounting groove 46 and the second intrusion suppressing groove 49 on the outer peripheral surface of the outer arrangement portion 41 of the connector housing 23 and configured to suppress a movement of a liquid from the second intrusion suppressing groove 49 toward the second mounting groove 46. This barrier wall may be an annular barrier wall extending over the entire periphery of the outer peripheral surface of the outer arrangement portion 41.

In FIG. 7, the cut portion 101 allowing communication between the second intrusion suppressing groove 49 and the outside of the shield shell 24A is an example of a drain passage for discharging a liquid to the outside of the connector 20 from the second intrusion suppressing groove 49.

A state shown in FIGS. 3 and 6, i.e. a state where the second facing surface 84, i.e. the tip surface, of the shield shell 24 is directly in contact with the tip surface, i.e. the opening end surface, of the mounting portion 14 of the case 12, may be called a state where the inserting portion 31, which is an insulating tubular tip part of the connector housing 23, is completely inserted in the mounting portion 14 of the case 12. The mounting portion 14 of the case 12 is an example of a conductive tubular connector receiver. A radially inward surface of the mounting hole 15 extending from the outer opening 15*a* to the inner opening 15*b* is an example of an inner peripheral surface of the conductive tubular connector receiver (mounting portion 14). The X direction may be called an inserting direction of the connector 20 or the inserting portion 31 into the tubular connector receiver (mounting portion 14), and the inserting direction may be, for example, linear. The X direction may be called an axial direction of the tubular connector receiver (mounting portion 14) or an axial direction of the outer arrangement portion 41 of the connector housing 23.

The present disclosure includes the following implementation examples. Some of constituent elements of illustrative embodiments are denoted by reference signs not for limitation, but for understanding assistance. Some of matters described in the following implementation examples may be omitted or some of the matters described in the implementation examples may be selected or extracted and combined.

[Addendum 1] A connector (20) according to some of the implementation examples of the present disclosure may be configured to be electrically and mechanically connected to a conductive tubular connector receiver (14). The connector (20) may include an insulating tubular connector housing (23) and a conductive tubular shield shell (24). The tubular connector housing (23) may integrally include a tubular tip portion (31) to be inserted into the tubular connector receiver (14) in an inserting direction (X) and a tubular base end portion (41) not covered by the tubular connector receiver (14) with the tubular tip portion (31) completely inserted in the tubular connector receiver (14). With the tubular tip portion (31) completely inserted in the tubular connector receiver (14), the shield shell (24) may have a tip surface (84) directly in contact with and electrically connected to a reception opening end surface of the tubular connector receiver (14). The outer peripheral surface of the tubular base end portion (41) may include, at a position separated from the tip surface (84) of the shield shell (24) by a first distance along an axial direction (X) of the tubular connector housing (23), an annular sealing element mounting groove (46) configured such that an annular sealing element (71) is mounted therein to radially and resiliently contact the inner peripheral surface of the tubular shield shell (24). The outer peripheral surface of the tubular base end portion (41) may include, at a position adjacent to the tip surface (84) of the tubular shield shell (24) or separated from the tip surface (84) of the tubular shield shell (24) by a second distance shorter than the first distance along the axial direction (X), a first annular groove-like liquid buffer zone (49) having a liquid storage space capable of temporarily storing or holding a liquid.

[Addendum 2] In some of the implementation examples, the tubular base end portion (41) can include a barrier wall (47*a*) configured to suppress a flow of the liquid from the first annular groove-like liquid buffer zone (49) toward the annular sealing element mounting groove (46) between the first annular groove-like liquid buffer zone (49) and the annular sealing element mounting groove (46) in the axial direction (X). This barrier wall (47*a*) may extend over the entire periphery of the outer peripheral surface of the tubular base end portion (41).

[Addendum 3] In some of the implementation examples, the barrier wall (47*a*) may have a radially outward edge, and this radially outward edge may be configured to directly contact the inner peripheral surface of the tubular shield shell (24).

[Addendum 4] In some of the implementation examples, the first annular groove-like liquid buffer zone (49) may define an empty space and may not be occupied by a resilient element or sealing element with the tubular tip portion (31) completely inserted in the tubular connector receiver (14).

[Addendum 5] In some of the implementation examples, the tubular shield shell (24) may include a drain passage allowing communication between the first annular groove-like liquid buffer zone (49) and the outside of the shield shell (24).

[Addendum 6] In some of the implementation examples, a width of the first angular groove-like liquid buffer zone (49) may be smaller than a groove width of the annular sealing element mounting groove (46).

[Addendum 7] In some of the implementation examples, the tubular base end portion (41) and the shield shell (24) may not be inserted in the tubular connector receiver (14) with the tubular tip portion (31) completely inserted in the tubular connector receiver (14).

[Addendum 8] In some of the implementation examples, the tip surface (84) of the tubular shield shell (24) may have a radially inner end surface (49B) facing the opening end surface of the tubular connector receiver (14) in a non-contact manner and a radially outer end surface directly in contact with the opening end surface of the tubular connector receiver (14), and the radially inner end surface (49B) of the tip surface (84) of the tubular shield shell (24) may radially communicate with the first annular groove-like liquid buffer zone (40) over the entire periphery.

[Addendum 9] In some of the implementation examples, the tip surface (84) of the tubular shield shell (24) may have a radially inner end surface (49B) facing the opening end surface of the tubular connector receiver (14) in a non-contact manner and a radially outer end surface directly in contact with the opening end surface of the tubular connector receiver (14), and the radially inner end surface of the tip surface (84) of the tubular shield shell (24) may include a second annular groove-like liquid buffer zone (49A) defining a liquid storage space capable of temporarily storing or holding a liquid.

[Addendum 10] In some of the implementation examples, the tubular connector receiver (14) may be provided or formed on the case (12) for accommodating a device (11) to be installed in a vehicle, and the connector (20) may be provided on one end of a vehicle wiring harness.

LIST OF REFERENCE NUMERALS

11 . . . inverter as device
12 . . . case
13 . . . case body
14 . . . mounting portion
15 . . . mounting hole
15*a* . . . outer opening
15*b* . . . inner opening

16 . . . inclined surface
17 . . . fixing portion
18 . . . fixing hole
20 . . . connector
21 . . . wire
22 . . . terminal
22*a* . . . locking hole
23 . . . connector housing
24, 24A, 24B . . . shield shell
31 . . . inserting portion
32 . . . holding hole
33 . . . locking piece
34 . . . locking projection
35 . . . end surface
36 . . . first mounting groove
37 . . . positioning recess
38 . . . first intrusion suppressing groove
41 . . . outer arrangement portion
42 . . . locking claw
43 . . . locking projection
44 . . . accommodation hole
45 . . . locking hole
46 . . . second mounting groove
47*a*, 47*b* . . . mounting projection
48 . . . positioning recess
49, 49A, 49B . . . second intrusion suppressing groove as groove
51 . . . rubber plug
52 . . . back retainer
53 . . . fixing claw
54 . . . insertion hole
61 . . . case-side sealing member
62 . . . body portion
63 . . . positioning projection
71 . . . shield-side sealing member
72 . . . body portion
73 . . . positioning projection
81 . . . covering portion
82 . . . fixing portion
83 . . . first facing surface
84 . . . second facing surface
85 . . . connecting portion
86 . . . fixing hole
91 . . . shield conductor
101 . . . cut portion

What is claimed is:

1. A connector, comprising:

a connector housing including an inserting portion to be inserted into a mounting hole provided in a conductive case for accommodating a device to be installed in a vehicle and an outer arrangement portion integral with the inserting portion and to be arranged outside the case, a terminal electrically connected to an end part of a wire being arranged inside the connector housing, the outer arrangement portion including a first groove provided over an entire outer periphery of the outer arrangement portion;

a shield shell including a tubular covering portion for covering an outer periphery of the outer arrangement portion, the shield shell being electrically connected to the case; and a shield-side sealing member provided in the first groove and configured to seal between an outer peripheral surface of the outer arrangement portion and an inner peripheral surface of the covering portion, wherein at least one of a first facing surface of the covering portion facing the connector housing, a second facing surface of the covering portion facing the case and the outer peripheral surface of the outer arrangement portion includes a second groove provided over the entire outer periphery of the outer arrangement portion between the shield-side sealing member and the inserting portion, the second groove is provided at least in the outer peripheral surface of the outer arrangement portion, and the second groove provided in the outer peripheral surface of the outer arrangement portion overlaps an end surface of the covering portion at a side of the inserting portion in a facing direction of the outer peripheral surface of the outer arrangement portion and the inner peripheral surface of the covering portion.

2. The connector of claim 1, wherein:

an end surface of the covering portion at a side of the inserting portion is the second facing surface facing the case, and the second groove is provided in the second facing surface.

3. The connector of claim 2, wherein:

an end part of the covering portion at the side of the inserting portion includes a cut portion penetrating through the end part of the covering portion in a facing direction of the outer peripheral surface of the outer arrangement portion and the inner peripheral surface of the covering portion, and the cut portion communicates with the second groove provided in the second facing surface.

* * * * *